US005364132A

United States Patent [19]

Haas et al.

[11] Patent Number: 5,364,132

[45] Date of Patent: Nov. 15, 1994

[54] METHOD FOR ASSEMBLY AND ACTIVATION OF A REUSABLE SECURITY IDENTIFICATION BADGE

[75] Inventors: David J. Haas; Sandra F. Haas, both of Suffern, N.Y.

[73] Assignee: S.J.A. Trust, Suffern, N.Y.

[21] Appl. No.: 45,552

[22] Filed: Apr. 9, 1993

Related U.S. Application Data

[63] Continuation-in-part of Ser. No. 650,221, Feb. 4, 1991, abandoned.

[51] Int. Cl.[5] ..... B42D 15/10; A44C 3/00

[52] U.S. Cl. ..... 283/67; 283/94; 283/96; 283/901; 40/1.5

[58] Field of Search ..... 283/75, 94–96, 283/112, 114, 901, 67; 116/200, 2–7; 40/1.5, 1.6, 6

[56] References Cited

U.S. PATENT DOCUMENTS

| | | | |
|---|---|---|---|
| 1,454,837 | 5/1923 | Smith | 283/96 |
| 2,088,567 | 8/1937 | Ballou | 283/96 |
| 2,337,534 | 12/1943 | Barber | 35/1 |
| 2,780,015 | 2/1957 | Whitehead | 283/96 |
| 3,078,182 | 2/1963 | Crane, Jr. et al. | 117/68.5 |
| 3,520,124 | 7/1970 | Myers | 58/1 |
| 3,921,318 | 11/1975 | Calavetta | 283/75 X |
| 3,999,946 | 12/1976 | Patel et al. | 23/253 |
| 4,212,153 | 7/1980 | Kydonieus et al. | 368/62 |
| 4,432,630 | 2/1984 | Haas | 355/1 |
| 4,573,711 | 3/1986 | Hyde | 283/98 |
| 4,643,122 | 2/1987 | Seybold | 116/206 |
| 4,646,066 | 2/1987 | Boughman et al. | 340/540 |
| 4,737,463 | 4/1988 | Bhattacharjee et al. | 436/2 |
| 4,812,053 | 3/1989 | Bhattacharjee | 374/102 |
| 4,822,990 | 4/1989 | Tamada et al. | 235/492 |
| 4,846,502 | 7/1989 | Chang et al. | 283/96 X |
| 4,903,254 | 2/1990 | Haas | 368/327 |
| 4,987,849 | 1/1991 | Sherman | 116/206 |
| 5,058,088 | 10/1991 | Haas et al. . | |

*Primary Examiner*—Peter Dungba Vo
*Attorney, Agent, or Firm*—Weingram & Zall

[57] ABSTRACT

A method of assembly and activation of a reusable self-expiring Security Identification Badge is provided. The Badge includes a base substrate having a void indicia area. Also included is an ink substrate having an expired indicia area of a soluble ink and an adhesive surface. Also included is an overlay substrate having an ink dissolver and a display surface. When the Security I.D. Badge is issued, the inked substrate is attached to the base substrate, the inked substrate covering the void indicia area. The overlay substrate is then placed over and attached to the inked substrate, the ink dissolver in contact with the soluble ink of the ink substrate. The ink dissolver of the overlay substrate contacts and coacts with the soluble ink of the inked substrate to dissolve the ink and allow the ink to migrate through to the overlay substrate to the display surface, where it can be visually perceived, in a preselected time interval.

7 Claims, 1 Drawing Sheet

METHOD FOR ASSEMBLY AND ACTIVATION OF A REUSABLE SECURITY IDENTIFICATION BADGE

RELATED APPLICATIONS

This application is a continuation-in-part of U.S. patent application Ser. No. 07/650,221, filed Feb. 4, 1991, to Haas et al.

BACKGROUND OF THE INVENTION

1. Field of the Invention

This invention relates to a time indicator, and in particular to a FAIL-SAFE SECURITY ID BADGE which uses a time indicator and which provides a clear indication of expiration of the badge and which acts to prevent unauthorized use of the badge.

2. Related Art

A related time indicator is described in U.S. Pat. No. 4,212,153 to Kydonieus et al. Other related patents include: U.S. Pat. No. 2,337,534 to Barber; U.S. Pat. No. 3,078,182 to Krone, Jr. et al.; U.S. Pat. No. 3,520,124 to Myers; U.S. Pat. No. 3,999,946 to Patel; U.S. Pat. No. 4,643,122 to Seybold; U.S. Pat. No. 4,646,066 to Baughman; U.S. Pat. No. 4,737,463 to Bhattacharjee et al.; and, U.S. Pat. No. 4,903,254 to Haas et al.

U.S. Pat. No. 4,212,153 to Kydonieus et al. describes a laminated time indicator including a two-layer front indicator and a two-layer rear reservoir part. The front indicator part has an indicator layer with an outer display surface and an inner surface having an adhesive layer thereon, e.g., a pressure sensitive adhesive coated onto an opaque barrier layer such as vinyl. The rear reservoir part has a dye or ink film layer and a support card layer.

When assembled, the front part is placed on the rear part with the ink layer forming an assembly joint with the adhesive layer. The dye or ink dissolves in the adhesive. After a period of time the ink migrates from the inner film layer through the adhesive layer and indicator layer to be displayed on the outer surface. In one day, typically, the dye or ink may reach only 20% to 30% of its potential color capacity due to the gradual migration (or absorption) of the dye into the opaque indicator layer and due to the fact that as the concentration of dye increases at the surface, the rate at which the process progresses decreases. Thus, there is no clear indication of when the indicator expired. It is believed that this device has such deficiencies because the opaque indicator layer must be relatively thick to provide mechanical strength to the indicator, creating an extended distance across which the dye or ink must migrate. Also, the opaque indicator layer must have a relatively large quantity of filler, e.g., titanium dioxide, to confer opaqueness to it, and such fillers intermix and absorb with the dye as the dye migrates through the indicator layer, thus diluting or decreasing the intensity of the dye.

U.S. Pat. No. 2,337,534 to Barber, describes a magazine page exposure time indicator including a photosensitive paper sheet mounted on a magazine page, and a developed photographic film sheet having a series of adjacent portions of varying density mounted over the photosensitive paper sheet.

U.S. Pat. No. 3,078,182 to Krone, Jr., describes a heat-sensing, color-changing adhesive tape for a device to be sterilized in a hospital autoclave including an adhesive layer for attachment, a backing web over the adhesive layer and a visible colored layer over the backing web wherein the colored layer comprises a selected pigment disbursed in a resin binder.

U.S. Pat. No. 3,520,124 to Myers, describes a parked car time indicator which includes a first sheet having a first reactant and a second sheet having a second reactant and a release sheet which is peeled away to permit contact of the first sheet with the second sheet to begin a reaction which extends over a selected time interval and terminates with a color change of the reactants.

U.S. Pat. No. 3,999,946 to patel, describes a perishable product time-temperature history indicator which includes a substrate for attachment of the indicator to a product. The indicator shows changes in temperature along a Y-coordinate, over time plotted along the X-coordinate.

U.S. Pat. No. 4,643,122 to Seybold, describes a tamper-indicating security tag which includes a carrier material impregnated with a solution selective compound. The solution is used as a solvent in connection with a sealed enveloping container which controls the rate of diffusion of the solvent.

U.S. Pat. No. 4,646,066 to Baughman, describes an environmental exposure indicator device which includes a target having a tuned circuit and a selective element which receives an interrogation signal in a radio or microwave frequency range, and which also includes an antenna. The antenna receives the signal and the circuit converts the signal to an electrical current. The selective element has an electrical property that changes and responds to the electrical current. The electrical current is dependent upon such environmental factors as temperature, the combination of time and temperature, humidity, radiation, particular fluids and/or mechanical shock.

U.S. Pat. No. 4,737,463 to Bhattacharjee et al., describes a perishable product photoactivitable time-temperature indicator comprising a mixture of a thermally unreactive diacetylenic compound, a photosensitive compound which, on exposure to actinic radiation, forms an acid that converts the diacetylene to a thermally reactive product and an aqueous polymeric medium.

U.S. Pat. No. 4,903,254 to Haas et al., discloses a time indicator comprising: a front portion which includes a transparent layer, an ink display layer, a white barrier layer, an adhesive and ink dissolver layer; and a rear portion which includes a migrating ink pattern layer and a support part. When the time indicator is issued the front portion is placed onto the rear portion and the ink pattern layer is dissolved by the adhesive and ink dissolver layer. The ink pattern then migrates through the adhesive and ink dissolver layer, the white barrier layer, and the ink display layer to the ink display surface layer where it can be visually perceived.

OBJECTS AND SUMMARY OF THE INVENTION

It is an object of this invention to provide a Security I.D. Badge which provides a clear indication of expiration.

It is a further object of this invention to provide a reusable Security I.D. Badge which provides a relatively clear indication of expiration over a relatively short period of time.

It is an even further object of this invention to provide a Security I.D. Badge which acts to prevent unauthorized use of the badge.

It is another object of this invention to provide a Security I.D. Badge that is fail-safe.

It is still another object of this invention to provide a Security I.D. Badge which is tamper resistant.

Even another object of this invention is to provide a Security I.D. Badge that may be used only on the date it is issued.

Still a further object of this invention is to provide a Security I.D. Badge which is simple to use, yet effective.

Yet another object of this invention is to provide a Security I.D. Badge which may be easily and inexpensively manufactured.

It is even another object of the invention to provide a Security I.D. Badge that expires after a predetermined time interval.

Another object of this invention is to provide a Security I.D. Badge, the expiration of which may be visually observed.

Yet another object of this invention is to provide a Security I.D. Badge which may be reused.

The foregoing objects, as well as others, are achieved by the Security I.D. Badge of this invention. The badge includes a base substrate that may be formed of a paper or plastic card that may be encased in a transparent laminate. The card includes a void indicia area. Also included is an ink substrate having an expired indicia area, typically an inked surface, of a soluble ink, and a surface attachable to the base substrate, typically an adhesive surface. The inked substrate is of a size similar to the size of the void indicia area of the card. Also, included is an overlay substrate having on one surface an ink dissolver, typically an ink dissolving adhesive surface and a display surface.

When the Security I.D. Badge is issued, the inked substrate is attached to the base substrate, the inked substrate covering the void indicia area of the card. The overlay substrate is then placed over the inked substrate, the ink dissolver of the overlay substrate in contact with the inked surface of the inked substrate.

Typically, the date of issuance is written on the display surface of the overlay substrate. The ink dissolver of the overlay substrate contacts and coacts with the inked surface of the inked substrate to dissolve the ink and allow the ink to migrate through the overlay substrate to the display surface, where it can be visually perceived, in a selected time interval.

The foregoing and other objects, features and advantages of this invention will be apparent from the following description of the preferred embodiment of the invention as illustrated in the accompanying drawings.

DESCRIPTION OF THE PREFERRED EMBODIMENT

Figure 1:
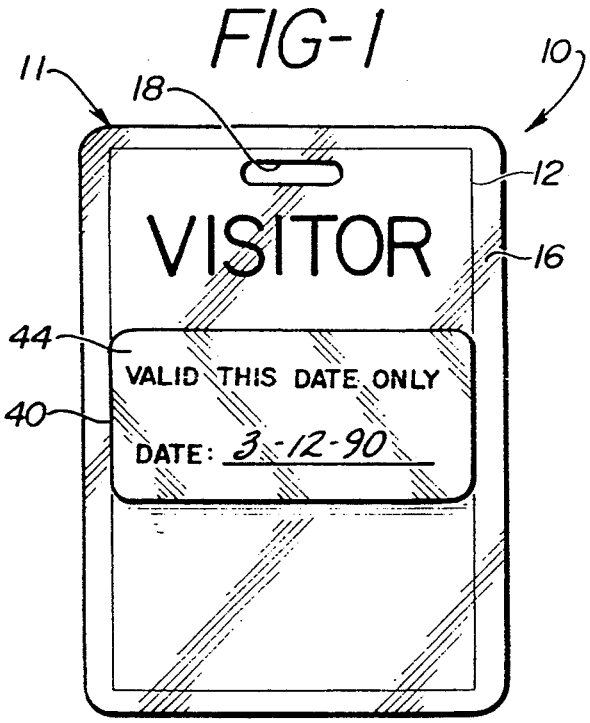
FIG. 1 is a front plan view of the Security I.D. Badge of the present invention immediately after it has been issued.
Figure 2:
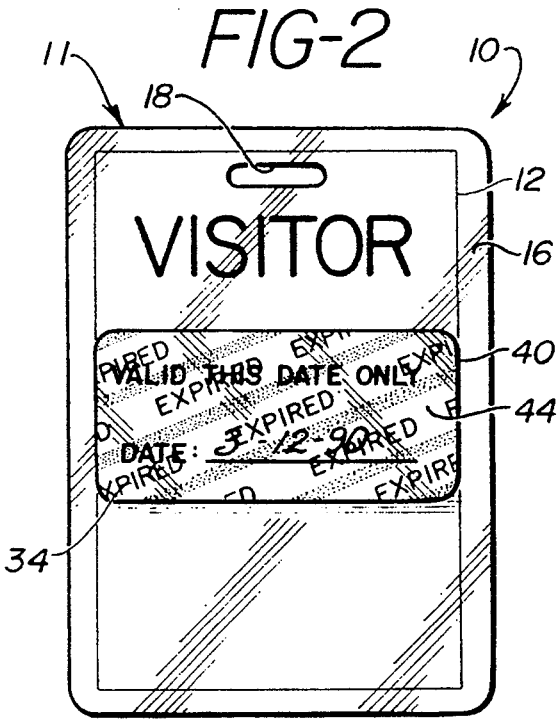
FIG. 2 is a front plan view of the Security I.D. Badge of the present invention after expiration thereof.
Figure 3:
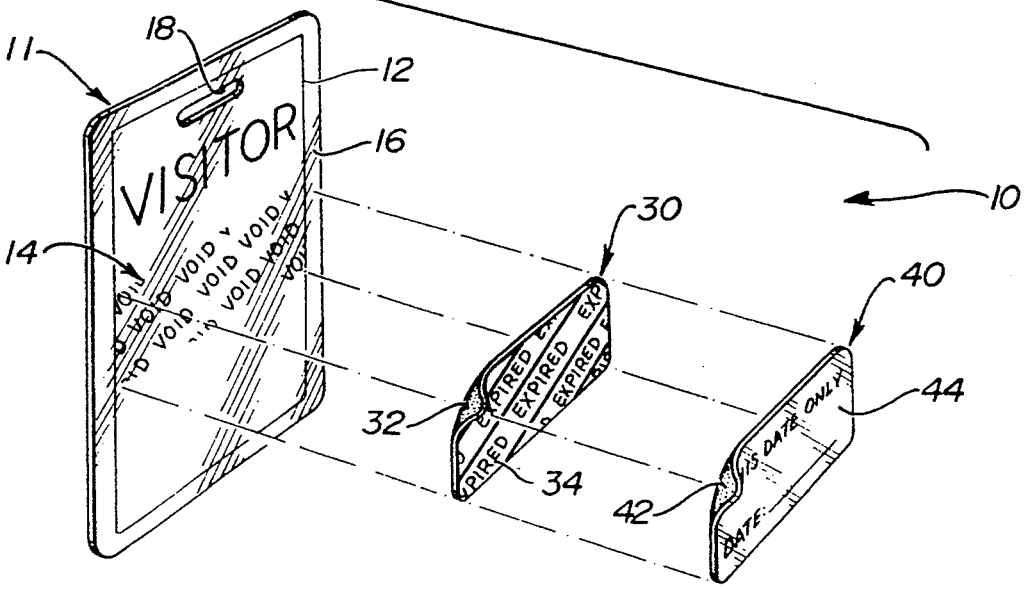
FIG. 3 is an exploded perspective view of the Security I.D. Badge of the present invention, corresponding to FIG. 1, prior to adhesive engagement of the substrates.

As shown in FIGS. 1 through 3, a Security I.D. Badge 10 is provided. The term "Security I.D. Badge", as used herein, is intended to encompass not only a badge issued to a visitor at a facility, but is also meant to include, without being limited to, such things as: passes, tickets, permits, control documents, photo-identification badges, etc. The badge 10 is constructed from three substrates 11, 30 and 40.

The base substrate 11 typically comprises a card 12 encased in a transparent laminate 16. The base substrate may, however, be comprised of a plastic or paper card. The base substrate 11 is attachable to the clothes of a person. In the preferred embodiment, the attachment means includes a support means 18 comprised of an elongated oval aperture extending through the base substrate.

The card 12 is typically of a prominent color to provide ease of visibility. Generally, at the top of the card 12, is the word "visitor". Also on the card 12 is a void indicia area 14. Within the void indicia area 14 is typically a voided pattern comprising the word "void" printed repeatedly along horizontal lines extending across the void indicia area.

The inked substrate 10 is generally of a size similar to that of the void indicia area 14 of card 12. The inked substrate 30 is attachable to the base substrate. Typically, the inked substrate 30 comprises an adhesive surface 32 and an expired indicia area 34, typically an inked surface. The inked surface 34 carries a soluble ink, typically in the pattern of the word "expired" appearing repeatedly along lines extending horizontally across the inked substrate 30. In another embodiment, the Security I.D. Badge is constructed without the inked substrate 30, and the soluble ink may be applied directly to the base substrate.

The overlay substrate 40 comprises an ink dissolver typically in the form of an ink dissolving adhesive on an ink dissolving adhesive surface 42 and a display surface 44. The overlay substrate 40 is typically similar in size to the inked substrate 30 and the void indicia area 14 of card 12. The display surface 44 typically contains the phrase: "VALID ON THIS DATE ONLY" or a phrase similar thereto. Further, a date line is generally provided so that the date on which the Security I.D. Badge 10 is valid may be written on display surface 44 prior to issuance of the badge.

The display surface 44 of the overlay substrate 40 in the preferred embodiment is divided into a transparent front layer with a front print display surface, an ink display layer, and an optical barrier layer. While not shown in the drawings, this construction is described in detail in U.S. Pat. No. 4,903,254 entitled "Time Indicator Enhancement Method" to David J. Haas, the entire disclosure of which is incorporated herein by reference.

Generally the Security I.D. Badge 10 is assembled and activated by a security person, issued to a visitor at a facility, and expires after a specified time interval. When the Security I.D. Badge 10 is issued, the inked substrate 30 is adhesively secured to the base substrate 11 in a position so as to cover the void indicia area 14 of card 12. Then, the overlay substrate 40 is adhesively positioned over the inked substrate 30. Finally, the date of issue is completed on the display surface 44 of overlay substrate 40. The Security I.D. Badge 10 may then be secured by means of pin support 18 to a pin fastened to the visitor's clothing.

Importantly, the SECURITY IDENTIFICATION BADGE of the present invention is reusable. As such, it includes a reusable base substrate. The base substrate has a void indicia area and an attachment means. The inked substrate that is adhesively applied to the base substrate has an expired indicia area of soluble ink on one surface and an adhesive on the other surface. This inked substrate is removably attached to the reusable base substrate, to cover the void indicia area. The overlay substrate has an ink dissolver on one surface and a display surface on the other surface. It is applied adhesively to the inked substrate. The ink dissolver of the overlay substrate contacts and coacts with the soluble ink of the inked substrate to dissolve the ink. The migrating ink migrates through the overlay substrate to the display surface where it can be visually perceived in a selected time interval to indicate expiration of the badge. After expiration of the badge, the inked substrate and the overlay substrate may be removed from base substrate to expose the void indicia area. Then the base substrate may be reused.

As time progresses, the ink dissolving adhesive on the ink dissolving adhesive surface 42 of overlay substrate 40 contacts and coacts with the soluble ink on inked surface 34 of inked substrate 30, to dissolve the ink and allow the ink to migrate through the ink dissolving adhesive surface 42, through the optical barrier layer of the overlay substrate 40, to the ink display layer of display surface 44 where it can be visually perceived through the transparent front layer. The migration of ink takes place at a rate such that it can be visibly perceived through the transparent front layer of display surface 44 of overlay substrate 40 upon the passage of a specified time interval.

The time periods for which the Security I.D. Badge 10 is valid may be varied and are controlled by the use of different inks applied to the inked surface 34 of inked substrate 30. Inks of more or less solubility or greater or lessor concentration will result in varying time periods.

Time periods may also be varied by varying the strength and concentration of the ink dissolving adhesive on the ink dissolving adhesive surface 42 of overlay substrate 40. Further, the time periods may be varied by increasing or decreasing the size of the optical barrier layer, and/or doping the optical barrier layer. Thus, this invention contemplates Security I.D. Badges with validation times of many different time periods, even extending from one day to one week to one month.

Upon expiration of the Security I.D. Badge 10 a visible indication is provided. This indication cannot be overcome by the visitor through tampering. For example, if the visitor attempts to remove the overlay substrate 40 from the inked substrate 30 it is likely that both will be removed from the base substrate 11 thereby uncovering the void indicia area 14 of card 12 and revealing the "void" message. Another possibility is that the visitor removes the overlay substrate 40 from the ink substrate 30 which is likely to tear the ink substrate 30 leaving it in disrepair, and alerting security to both the expiration of the Security I.D. Badge 10 and the visitor's tampering therewith. Alternatively, the overlay substrate could be neatly removed from the ink substrate which would only result in the inked surface 34 of the ink substrate 30 being visible, again alerting security to the expiration of the Security I.D. Badge 10 and to the visitor's tampering therewith.

Importantly, the base substrate 11 may be reused with new inked substrates and overlay substrates. Thus, this badge presents a significant economical savings over conventional badges which are typically discarded by the purchaser after expiration. Further savings arise because the expiration indicator components of the badge, which must be issued with each issuance of the badge, are generally relatively small in size with respect to the badge. Areas of use of the Security I.D. Badge of the present invention include facilities where there are visitors, use by contractors, use by temporary employees, etc.

Importantly, lost and/or unreturned Security I.D. Badges automatically self expire and thus prohibit unauthorized use.

As set forth in U.S. Pat. No. 5,058,088, to Haas et al., the entire disclosure of which is incorporated herein by reference, preferred soluble inks for use with this invention are from Gans Ink Co., Las Angeles, Calif. In particular, Pyroscript Sublimination Inks, eg. ink Nos. 579,77, 57,976, heat transfer inks, Turn-A-Bout, Sunrise Process, and Turn-A-Bout R.S. Series Inks.

Additionally, as set forth in U.S. Pat. No. 5,058,088 to Haas et al., almost any adhesive which is receptive to the dyes in inks can be used. By adding polar and/or non-polar materials to the adhesive, the absorption properties of the adhesive can be altered. Preferred adhesives are from Avery Company, Fasson Films Division, Painesville, Ohio.

Other examples of inks that can be used to practice Applicant's claimed invention are set forth in U.S. Pat. No. 4,212,153 to Kydonieus et al. For example, in general, organic dye can be a migrating agent in the present invention. Dyes that are extremely bulky with respect to molecular structure or are highly polymeric will show a reduced migration speed. (Column 5, line 43). Thereafter, Kydonius et al., goes on to set forth numerous examples of inks that may be used as migrating means. Additionally, Kydonius et al, discusses agents for use in dissolving ink.

Still further, as is well known in the art, inks of low molecular weight such as those used in sublimation inks and thermotransfer ribbons (a well developed art) are suitable for use in practicing the present invention. Such inks are readily available from ink supply companies. Additionally, it is well known by those skilled in the art that low acrylic adhesives dissolve soluble ink or sublimating dyes, and permit migration thereof. High molecular weight acrylics and rubber adhesives, on the other hand, are relatively poor in dissolving such inks and causing their migration.

The choice of ink and the adhesive depends on the desired time interval between activation and expiration of the badge that is desired. For short time intervals, such as minutes or hours, a very low molecular weight ink would be used in conjunction with a low monomer weight acrylic adhesive. Likewise, for a longer time period such as weeks or months, a high molecular weight ink with a very high molecular weight acrylic adhesive or similar rubber adhesive would be used.

A chemical interaction involved with dissolving the ink starts with dissolving the dye molecules contained therein. The dye molecules may be solvent based or water based and dissolved by either a solvent or water respectively. The solvent such as alcohol and keytones can be used to dissolve solvent based inks and emulsions can be used for dissolving water based inks.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A method for assembly and activation of a reusable security identification badge comprising the steps of:

(a) providing a reusable base substrate having a visible void indicia area on one surface there of;

(b) removably adhesively attaching an inked substrate to said one surface containing said visible void indicia area of the reusable base substrate to cover the void indicia area, the inked substrate having an expired indicia area of a soluble ink on one surface and an adhesive on the other surface, wherein the adhesive surface of said inked substrate is attached onto said base substrate;

(c) adhesively attaching an overlay substrate to the inked substrate, the overlay substrate having an ink dissolver on one surface and a display surface on the other surface, the ink dissolver surface of said overlay substrate is attached onto the soluble ink surface of said inked substrate;

wherein the ink dissolving adhesive of the overlay substrate contacts and coacts with the soluble ink of the inked substrate to dissolve the ink, the ink migrating through the overlay substrate to the display surface, where it can be visually perceived through the display surface of said overlay substrate in a selected time interval, to indicate the expiration of the badge;

(d) after indication of expiration, removing the removably adhesively attached inked substrate having attached thereto the overlay substrate, from the reusable base substrate to expose the void indicia area; and (e) repeating, at least once, steps (b) and (c).

2. The method of claim 1 wherein the step of repeating steps (b) and (c) further includes the step of repeating step (d).

3. The method of claim 2, wherein the reusable base substrate includes an attachment means.

4. The method of claim 3, wherein the attachment means comprises an aperture in the reusable base substrate.

5. The method of claim 1, wherein the display surface of the overlay substrate includes an area wherein the expiration date of the security identification badge may be written.

6. The method of claim 1, wherein the void indicia area of the reusable base substrate is printed with the word "void".

7. The method of claim 1, wherein the inked substrate is of a size similar to the size of the void indicia area of the reusable base substrate.

* * * * *